US005636478A

United States Patent [19]

Chen

[11] Patent Number: 5,636,478

[45] Date of Patent: Jun. 10, 1997

[54] INFLATABLE TENT STRUCTURE

[75] Inventor: Ching-Cheng Chen, Pan Chiao, Taiwan

[73] Assignee: Jhy Yih Electric Enterprise Co., Ltd, Taichung Hsien, Taiwan

[21] Appl. No.: 421,445

[22] Filed: Apr. 13, 1995

[51] Int. Cl.[6] ..... E04H 15/20; A45F 3/00

[52] U.S. Cl. ..... 52/2.11; 52/2.18; 52/2.22; 135/96; 135/126; 135/137; 135/116

[58] Field of Search ..... 52/2.11, 2.17, 52/2.18, 2.22, 2.23, 2.24; 135/96, 126, 128, 87, 88.01, 124, 137, 116

[56] References Cited

U.S. PATENT DOCUMENTS

| | | | |
|---|---|---|---|
| 2,830,606 | 4/1958 | Daugherty | 52/2.24 X |
| 4,000,585 | 1/1977 | Denaro | 52/2.17 |
| 4,000,749 | 1/1977 | Busco | 52/2.17 X |
| 4,590,956 | 5/1986 | Griesenbeck | 135/116 |
| 4,766,918 | 8/1988 | Odekirk | 52/2.23 |
| 4,888,837 | 12/1989 | Wang | 5/414 X |
| 5,007,212 | 4/1991 | Fritts et al. | 135/116 X |
| 5,205,086 | 4/1993 | Heim | 52/2.18 X |
| 5,226,261 | 7/1993 | Wilbourn et al. | 52/2.22 X |
| 5,247,768 | 9/1993 | Russo | 52/2.22 X |

FOREIGN PATENT DOCUMENTS

| | | | |
|---|---|---|---|
| 0635028 | 1/1962 | Canada | 52/2.18 |
| 2190408 | 11/1987 | United Kingdom | 52/2.18 |

*Primary Examiner*—Wynn E. Wood
*Attorney, Agent, or Firm*—Bacon & Thomas

[57] ABSTRACT

An inflatable tent structure for single person use or multiple person use, comprising an inflatable tent and an automatically inflatable cushion placed in the tent, wherein the tent is made of two sheets of waterproof nylon PU cloths by means of cutting, adhering and sewing. At least a joint portion between two adjacent faces being is disposed with an inflating passage which can be inflated and expanded to stretch and support the tent. An inflating valve is disposed on the inflating passage and each long face of the tent is disposed with ventilating windows. The cushion is formed by an upper and a lower waterproof nylon PU cloths and a sponge layer sandwiched therebetween an inflating valve is disposed on a corner of the cushion. The cushion is adapted to be placed and secured on the bottom of the tent for a user to sit or lie thereon. The material of the tent structure is recoverable and can be burned without producing toxic gas.

3 Claims, 7 Drawing Sheets

INFLATABLE TENT STRUCTURE

BACKGROUND OF THE INVENTION

The present invention relates to an inflatable tent structure for single person use or multiple person use. The tent structure is made of recoverable waterproof nylon cloth and has light weight. In addition, the tent structure can be easily constructed without using rigid beam members and can be folded into a small volume for easy storage and carriage.

Conventional tent structures mostly have heavy weight and large volume as well as complicated components. When constructed, the support frame members and waterproof cover members are assembled in a troublesome and time-costing manner. Such assembling procedure can be hardly accomplished by one single person. Moreover, after used, it is also difficult to collapse and fold as well as pack and carry the tent structure. Furthermore, in case one of the components is lost during the packing or transferring procedure, the entire tent structure will become unconstructable and useless.

Therefore, it is necessary to provide an improved tent structure which has light weight and small volume and can be easily quickly constructed by single person.

SUMMARY OF THE INVENTION

It is therefore a primary object of the present invention to provide an inflatable tent structure for single person use or multiple person use. The tent structure includes an inflatable tent and an automatically inflatable cushion. The inflatable tent is formed with inflating passages which can be inflated to stretch open and support the tent instead of the conventional support frame members.

It is a further object of the present invention to provide the above tent structure in which the inflatable tent is disposed with removable sheet on one side or two sides and a loop-hook fastener is disposed along the inflating passage, whereby the sheets of multiple tents can be removed and the tents can be associated with one another by engaging the loop-hook fasteners with each other to form a large tent for multiple person use.

It is still a further object of the present invention to provide the above tent structure in which in the instant of opening the valve cap of the inflating valve of the inflatable cushion, an inner sponge layer thereof immediately automatically spreads out to suck air into the cushion and expand the same for a user to sit or lie thereon.

According to the above objects, the tent structure of the present invention is made of recoverable waterproof nylon cloth and has light weight. In addition, the tent structure can be easily stretched open and supported by means of inflating the inflating passages without using any rigid beam members. Moreover, after deflated, the tent structure can be easily collapsed and folded into a small volume for easy storage and carriage.

The present invention can be best understood through the following description and accompanying drawings, wherein:

DETAILED DESCRIPTION OF THE PREFERRED EMBODIMENTS

Figure 1:
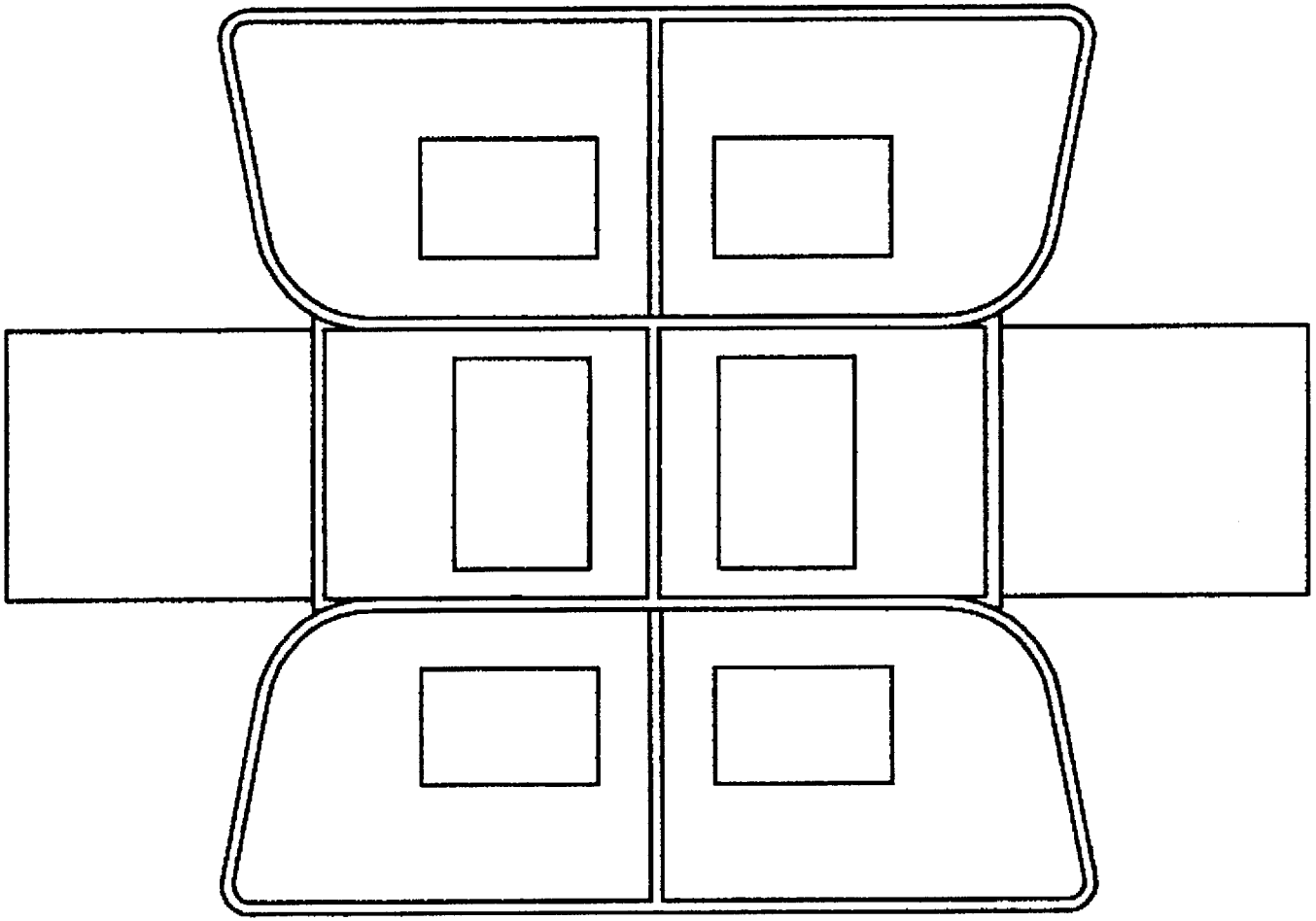
FIG. 1 is a plane stretched view of the inflatable tent structure of the present invention.
Figures 2, 2A:
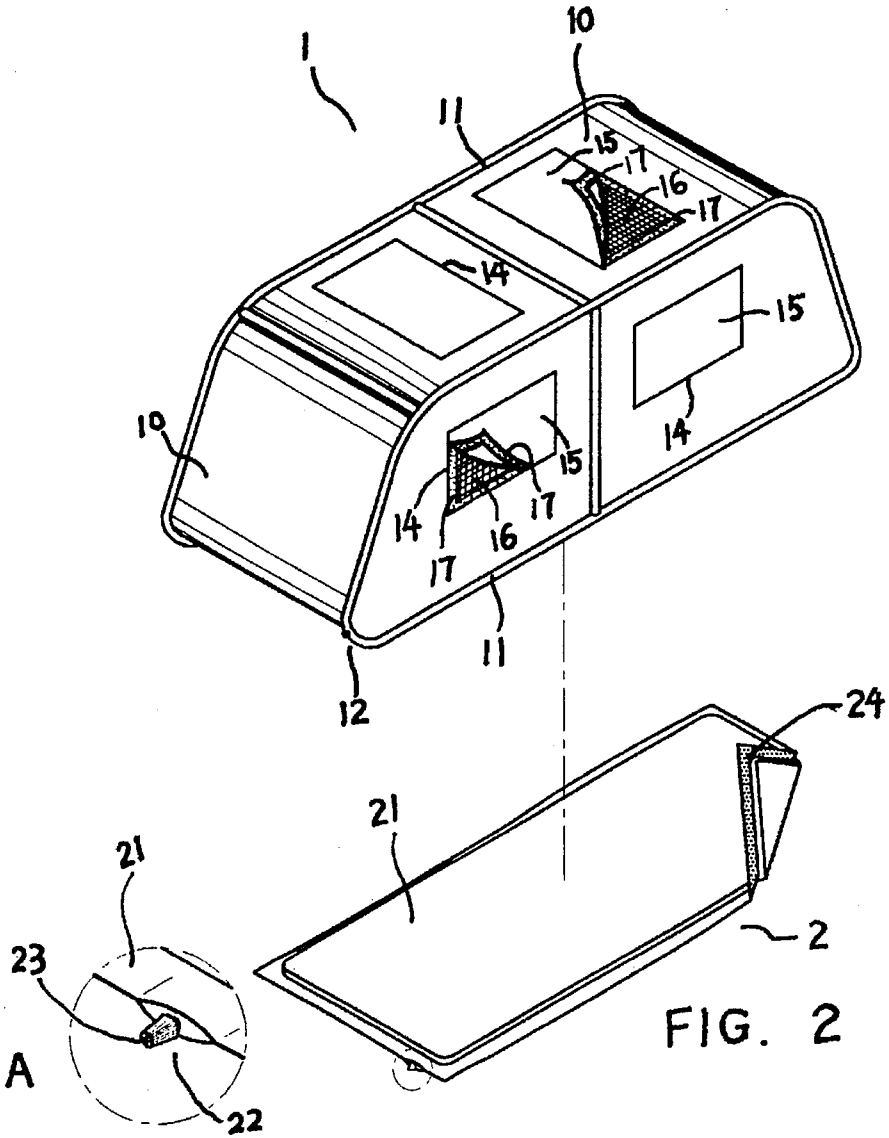
FIG. 2 is a perspective exploded view of the tent structure of the present invention.
FIG. 2A is an enlarged view of the inflating valve of the inflatable cushion of the present invention.

Please refer to FIGS. 1 and 2. The inflatable tent structure of the present invention includes an inflatable tent 1 and an automatically inflatable cushion 2. The tent 1 is made of two sheets of waterproof nylon cloth 10 by means of cutting, adhering and sewing. The joint portion between two adjacent faces is not applied with adhesive agent and is reserved as an inflating passage 11. In addition, an inflating valve 12 is disposed on the inflating passage 11 on one short side of the tent 1. The inflating valve 12 has an airtight screw valve cap 13 as shown in FIG. 4A. Each long face of the tent 1 is disposed with two windows 14 made of waterproof nylon PU cloth 15 by cutting and having loop-hook fastener 17 along the periphery. A ventilating mesh 16 is disposed in the window 14 by sewing for preventing insects from flying into the tent 1. Inside the tent 1 is disposed loop-hook fastener not shown) at the bottom corresponding to the loop-hook fastener 24 of the inflatable cushion 2.

The cushion 2 is formed by an upper and a lower waterproof nylon cloth 21 and a sponge layer 20 sandwiched therebetween. The periphery of the cushion 2 is airtightly sealed. Also, an inflating valve 22 is disposed on a corner of one short side of the cushion 2, having an airtight screw valve cap 23 as shown in FIG. 2A. Along the periphery of the bottom of the cushion 2 is disposed loop-hook fastener 24 for associating the cushion 2 with the tent 1.

Figure 3A:
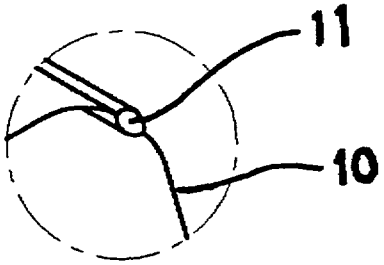
FIG. 3A is an enlarged view of the inflating passage of the present invention.
Figure 3:
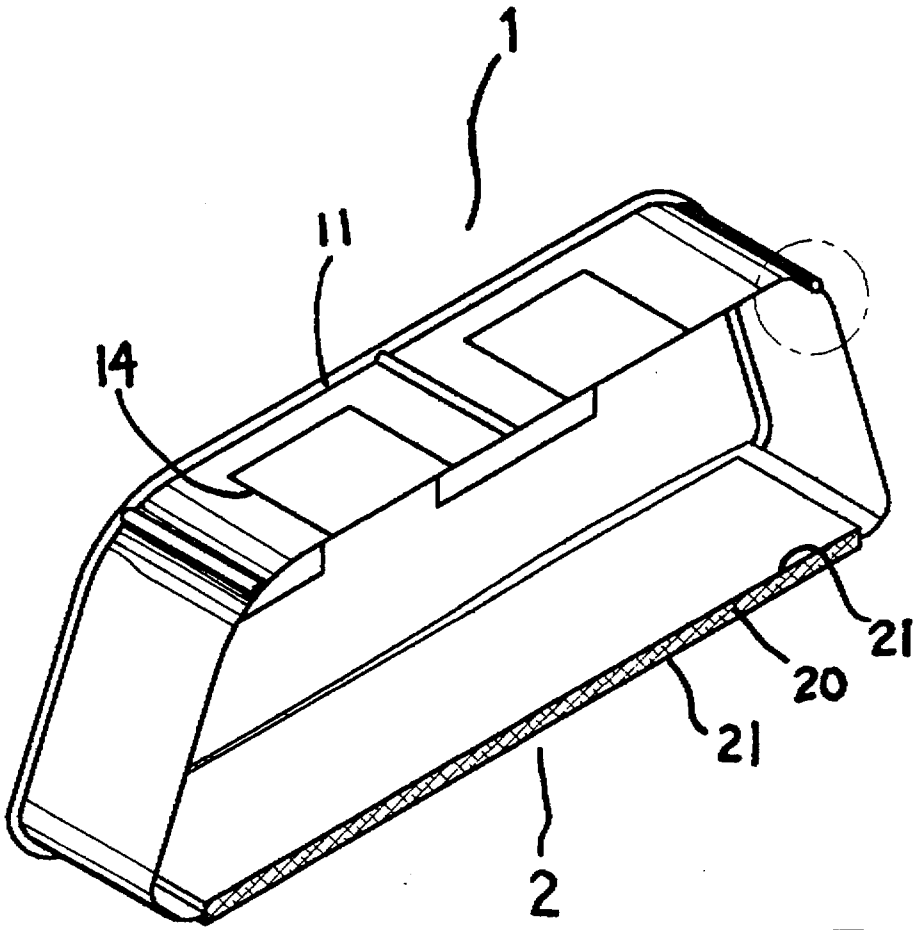
FIG. 3 is a perspective sectional assembled view of the tent structure of the present invention.

Please refer to FIG. 3. The inflating passage 11 of the tent 1 is defined by two layers of waterproof nylon cloth 10 which are free from adhesive agent, whereby the inflating passage 11 can be inflated with air without obstacle.

Figure 4:
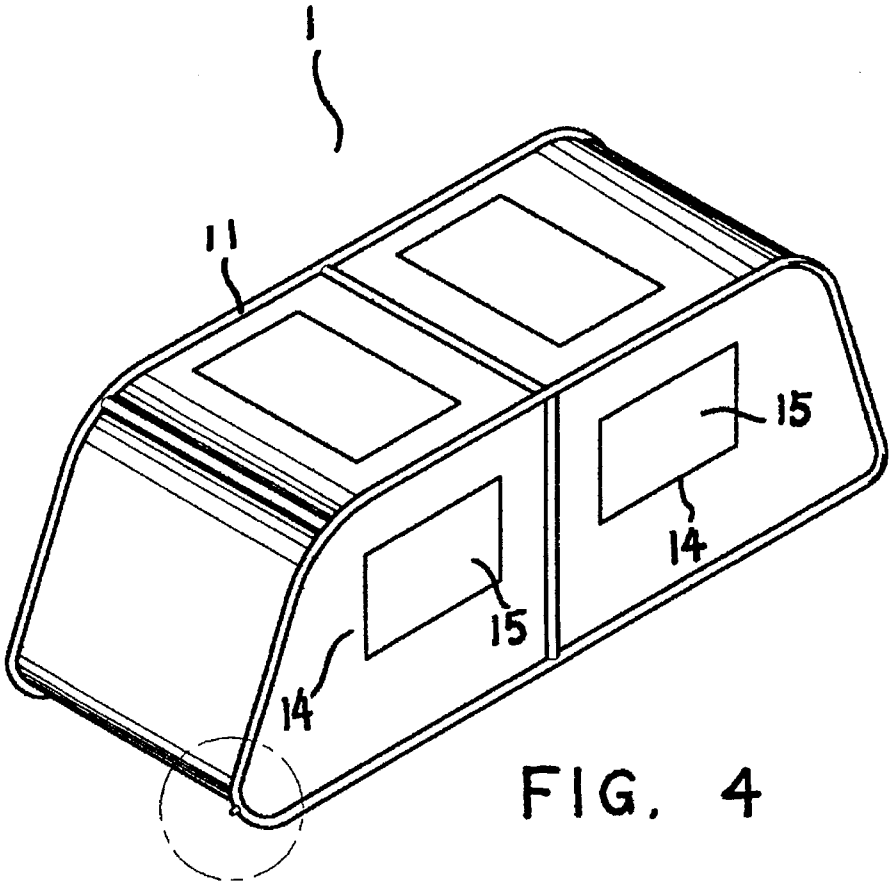
FIG. 4 is a perspective assembled view of the tent structure of the present invention for single person use.
Figure 4A:
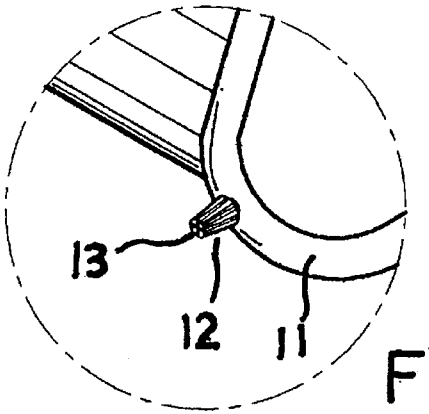
FIG. 4A is an enlarged view of the inflating valve of the inflating passage of the tent structure.

Please refer to FIG. 4. When constructing the tent 1 for single user, the inflatable tent 1 is first taken out from an envelope and spread open. Then the inflating valve 12 of the tent 1 is connected to an inflating pump for inflating air entirely through the inflating passage 11. After fully inflated, the inflating pump is removed. In the instant of removing the inflating pump, the valve cap 13 is quickly tightened. At this time, the construction of the tent 1 is completed. Thereafter, the inflatable cushion 2 is taken out. Because the cushion 2 has the inner sponge layer 20, after the valve cap 23 of the inflating valve 22 is opened, the inner sponge layer 22 immediately automatically spreads out. Thereafter, the valve cap 23 is tightened. If it is desired to further inflate the cushion 2, the inflating pump can be connected with the inflating valve 22 to inflate the cushion 2 to the necessary extent. Then the valve cap 23 is airtightly tightened and the cushion 2 is placed on the bottom of the tent 1 for use. When a user wishes to enter the tent 1 and rests therein, the windows 14 on three faces of the tent 1 are first opened to ventilate the tent 1 and then one corner of the tent 1 is lifted so that the user can enter the tent 1. Thereafter, the cushion 2 is accurately aligned with the tent 1 and then the loop-hook fastener 24 of the cushion 2 is binded with the loop-hook fastener of the bottom of the tent, whereby the user can comfortably sit or lie on the cushion 2.

Figure 5:
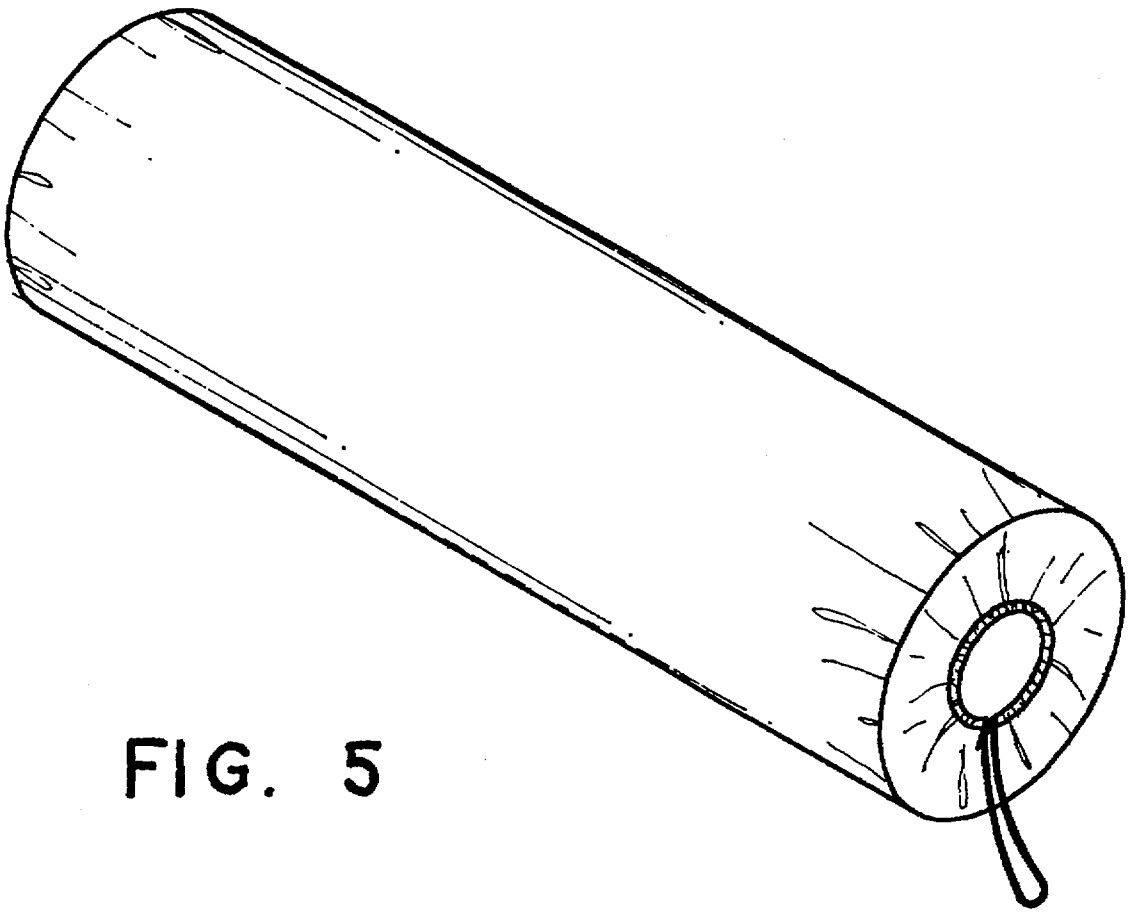
FIG. 5 shows that the tent and cushion can be deflated and folded into a small volume and packed in a small envelope.

Please refer to FIG. 5. When not used, the valve caps 13, 23 of the inflating valves 12, 22 are opened to deflate the inflating passage 11 and the cushion 2. Thereafter, the inflatable tent 1 together with the automatically inflatable cushion 2 is folded and placed into the envelope.

Figure 6:
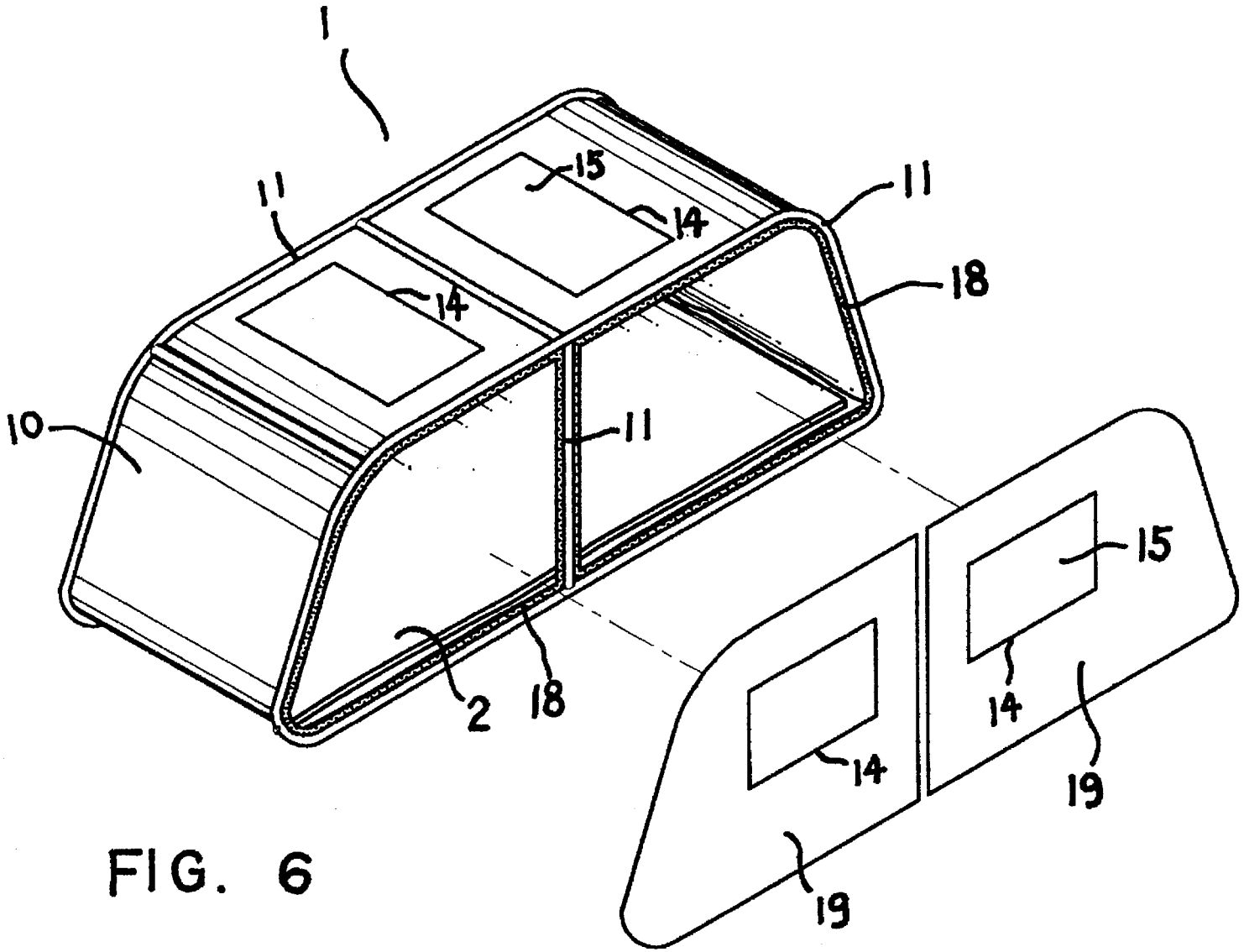
FIG. 6 is a perspective view of another embodiment of the inflatable tent which is adapted to associate with the other inflatable tent to form a large tent for multiple person uses.
Figure 7:
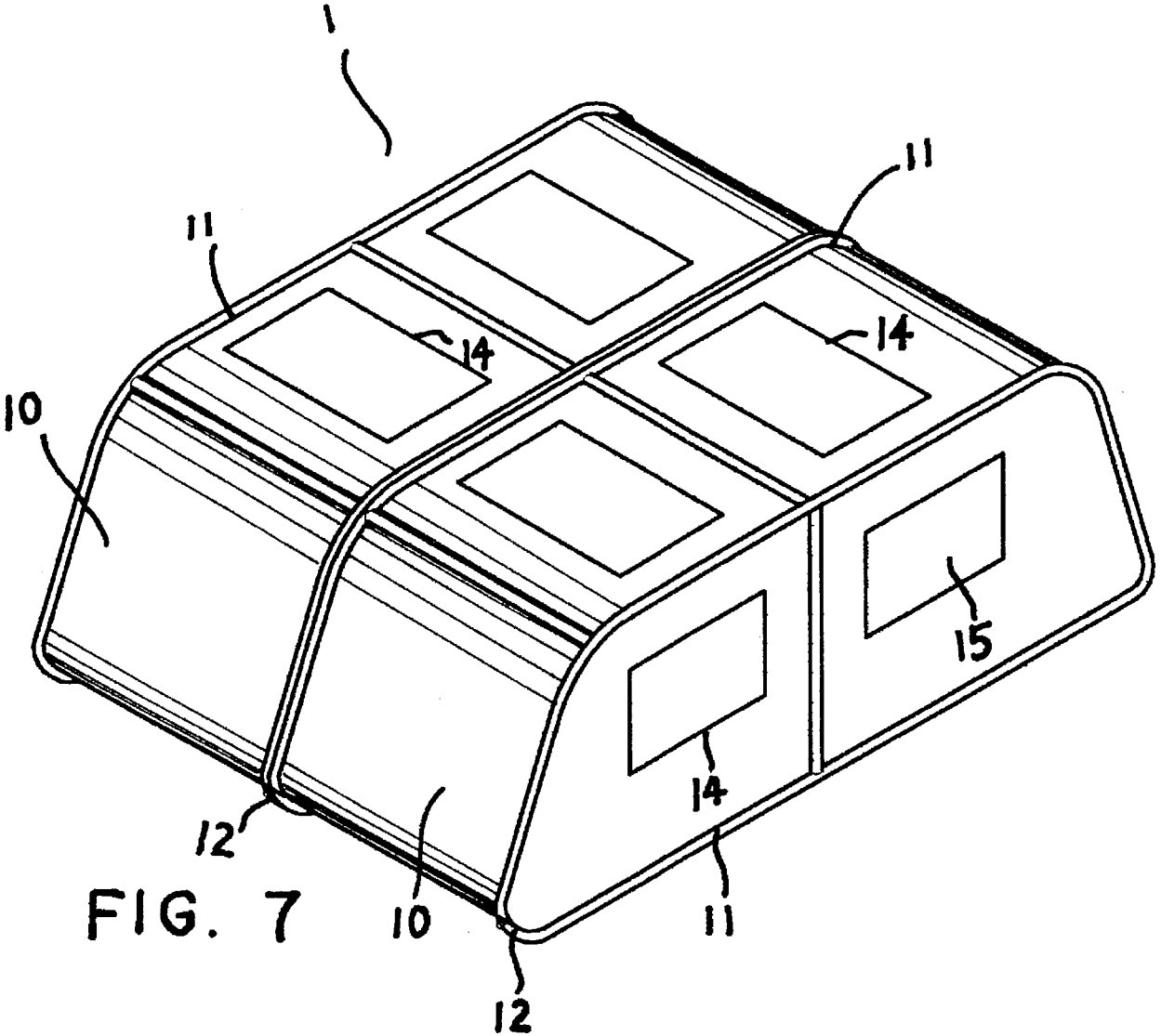
FIG. 7 shows a large tent structure assembled from the tent structure of FIG. 6.

Referring to FIG. 6, as to the inflatable tent structure for multiple person use of the present invention, one face of the inflatable tent 1 of FIG. 2 is replaced by a removable sheet 19 and a loop-hook fastener 18 is disposed along the inflating passage 11 for detachably associating with the removable sheet 19. Referring to FIG. 7, when it is desired to connect two tents 1 into a large tent, the sheets 19 of two tents 1 are removed and the two tents 1 are associated with each other by engaging the loop-hook fasteners 18 with each other. Accordingly, the tents 1 can be connected in series without limitation.

The advantages of the present invention are as follows:

1. The inflatable tent can be easily quickly constructed.

2. The inflatable tent can be easily tightly associated with the automatically inflatable cushion.

3. The constructed tent is well ventilated.

4. The tent and cushion can be deflated and folded to be placed in the envelope for easy carriage.

5. The tent structure has light weight without burdening the user during a travel.

6. The tent structure can be quickly constructed and collapsed and the tent and cushion can be folded and placed in the envelope without departing from each other.

7. The tent and cushion can be folded into a small volume and placed in the small envelope without occupying much room.

8. When there are many users, the removable sheets of several tents can be taken away and the tents can be associated by means of engaging the loop-hook fasteners thereof into a large tent for multiple people use.

The above embodiment is only an example of the present invention and the scope of the present invention should not be limited to the example. Any modification or variation derived from the example should fall within the scope of the present invention.

What is claimed is:

1. An inflatable tent structure having an inflatable tent and an automatically inflatable cushion placed in the tent, comprising:

a tent made of two sheets of waterproof nylon cloth having a joint portion between two adjacent faces forming an inflating passage; a first inflating valve disposed on the inflating passage the inflating valve having an airtight screw valve cap; a face of the tent having windows made of waterproof nylon cloth with a first loop-hook fastener located along a periphery thereof; a ventilating mesh disposed in the window; a second loop-hook fastener at a bottom of the tent;

a cushion formed by upper and lower layers of waterproof nylon cloth and a sponge layer sandwiched therebetween, a periphery of the cushion being airtightly permanently sealed; a second inflating valve on the cushion, having an airtight screw valve cap; a third hook-loop fastener along a periphery of the cushion for fastening with the second hook-loop fastener of the tent, so as to form the tent structure.

2. The inflatable tent structure as claimed in claim 1, wherein one face of the inflatable tent comprises a removable sheet and a fourth loop-hook fastener disposed along the inflating passage for detachably associating with the removable sheet, whereby the sheets of a plurality of tents can be removed and the tents can be fastened to one another by engaging the fourth loop-hook fasteners with each other to form a larger tent.

3. The inflatable tent structure as claimed in claim 1, comprising an inner sponge layer which automatically spreads out upon opening the second inflating valve to suck air into the cushion and thereafter the valve cap can be tightened and an inflating pump can be connected with the second inflating valve to additionally inflate the cushion.

* * * * *